US005495787A

United States Patent [19]

Boyer, III

[11] Patent Number: 5,495,787

[45] Date of Patent: Mar. 5, 1996

[54] ANTI-MISSILE MISSILES HAVING MEANS TO "BLIND", AND THUS RENDER INEFFECTIVE, PRECISION, SEEKER GUIDED MUNITIONS

[76] Inventor: Lynn L. Boyer, III, 2202 Manassas Dr., SW., Huntsville, Ala. 35803

[21] Appl. No.: 262,326

[22] Filed: Jun. 17, 1994

[51] Int. Cl.[6] ..... F42B 12/36

[52] U.S. Cl. ..... 89/1.11; 102/293

[58] Field of Search ..... 89/1.11; 102/293, 102/505

[56] References Cited

U.S. PATENT DOCUMENTS

| | | | |
|---|---|---|---|
| 4,333,402 | 6/1982 | Landstrom et al. | 102/505 |
| 4,421,007 | 12/1983 | Hanes, Jr. | 89/1.11 |
| 4,799,979 | 1/1989 | Baldi | 149/5 |
| 4,838,167 | 6/1989 | Prahauser | 102/334 |
| 4,867,034 | 9/1989 | Trosky et al. | 89/1.11 |
| 4,922,827 | 5/1990 | Remo | 102/496 |

*Primary Examiner*—Charles T. Jordan
*Assistant Examiner*—Christopher K. Montgomery
*Attorney, Agent, or Firm*—John C. Garvin, Jr.; Harold W. Hilton

[57] ABSTRACT

An anti-missile missile for preventing an incoming threat missile from impacting a target without requiring impact of the anti-missile missile with the incoming threat missile. The incoming threat missile is provided with a guidance and control system disposed for receiving a source of guidance energy from an external source for guiding the threat missile to impact with the target. The anti-missile missile includes a body having a container carried thereby and a shield device carried in the container for ejection from the container in the vicinity of the threat missile. The shield device is disposed for controlling the amount of guidance energy received by the guidance and control system thereby rendering the guidance and control system ineffective to guide the threat missile to the target. An ejection device is provided for ejecting the shield device in the vicinity of the threat missile.

10 Claims, 5 Drawing Sheets

ANTI-MISSILE MISSILES HAVING MEANS TO " BLIND" , AND THUS RENDER INEFFECTIVE, PRECISION, SEEKER GUIDED MUNITIONS

FIELD OF THE INVENTION

This invention generally relates to anti-missile missiles and more particularly concerns such missiles having means to render the guidance components of an incoming precision seeker guided threat missile inoperative for performing the mission of guiding the incoming missile to a target without requiring that the anti-missile impact with the incoming threat missile.

BACKGROUND OF THE INVENTION

Since the second World War, technological advances have permitted the construction of precision, seeker guided munitions (PSGM) that are actively guided during flight to their intended target and thus have a high probability of kill (PK). The high PK and the relatively inexpensive costs of these munitions, especially as compared to potential targets, make them cost effective weapons systems. The high PK, mature, available manufacturing technology, comparatively modest purchase price, and ready availability, have resulted in a proliferation of PSGMs. A variety of these systems are built and marketed by a multitude of companies and countries. As older PSGMs become obsolete and are replaced by more sophisticated systems, a large secondary market filters these older munitions to less financially endowed countries and organizations. This proliferation has increased the hazards from these weapons, both to combatants and non-combatants, especially as these munitions are obtained by fanatic/terrorist countries and/or organizations.

A precision, seeker guided munition is any munition, free fall or propelled that can be guided to its target via an onboard seeker and control system. The PSGMs addressed here are those that are either guided autonomously, that is, have an onboard or integral seeker and electronics sophisticated enough to recognize a target by shape, energy emissions/reflectance, comparison to a reference or other means, or are guided remotely but with the controller receiving target information through an on-munition seeker. PSGMs are characterized by their high PK and extreme lethality. PSGMs are a major threat, in all are as of combat, land, air and afloat. Man portable, seeker guided precision anti-aircraft missiles have the potential to be a significant terrorist threat to civil aviation.

Defense strategies to counter PSGMs are as varied as the possible munition's targets. An obvious defense stratagem is camouflage or preventing detection. Camouflage is attempted through paints that change the visual or energy reflective/emissive characteristic of a potential targets or by nets or materials that physically screen the target. Additional defensive ploys include decoys, obscurants, shoot downs and maneuver. Decoys attempt to mislead a precision guided munition so that is misses the target (flares and chaff are excellent examples), obscurants (smoke) hide the target behind an aerosol particulant distribution through which the target cannot be identified and methods are being attempted to shoot down a precision guided weapon, physically by blast or kinetics (thus far unsuccessful due to the small size, high speed and short flight time), or to disable the precision guided munitions seeker by directed energy, typically laser, thus rendering the missile unable to track its intended target.

Additionally, maneuver may be used if the target can perform vector or positional changes that exceed the PSGMs seekers ability to track or flight control system to compensate for to obtain a hit. Other methods described have varying degrees of success against different types of precision guided munitions. None is perfect, none works against all threats, and none works, singly or in combination, with a high degree of assurity to negate the threat of PSGMs.

PSGMs have several systems components in common. All PSGMs are minimally possessed of a seeker, a commanding system, a guidance system, a maneuvering (flight control) system and a warhead. In other words, precision guided munitions broadly encompasses everything from free fall bombs fitted with a seeker and flight control mechanism, artillery projectiles fitted with a seeker and fight control mechanism, to self propelled fire and forget anti-armor, anti-aircraft or anti-ship missiles. Analysis of these systems reveals that the common items are the seeker, command system, flight controls and warhead. Generally the warheads are fairly stable compounds that must be detonated by a specific firing impulse from a specific mechanism. Warheads are extremely difficult to detonate prematurely. The flight controls are mechanical devices or gas reaction jets that are controlled in a number of different ways depending upon the munition. They are robust mechanisms not easily disrupted by external influences. The command system is either an onboard system or a remote system connected through cables to the launching vehicle. Because of the wide variety of possible commanding sources, a single mechanism able to defeat several or all of the command system types if not considered practical. Practically all precision guided munitions contain a seeker that receives, then passes information to an onboard guidance system or to a remote system. The seeker on a precision guided munition may be tailored to any or several portions of the energy spectrum, however the point of similarity is that all seekers must receive energy to track their intended target. The energy reception portion of the seeker is a delicate and sensitive mechanism and is always protected by being located behind a window (faring, nose cone, glass, etc.) that is transparent to the energy frequency of interest. Disruption, degradation, elimination or overload of energy receipt by the seeker effectively binds the PSGM. A blind PSGMs probability of striking its intended target decreases as a function of the distance away from the target the munition is blinded, the dynamics of the atmosphere through which the munition is moving, the control laws governing the munitions flight path and the maneuverability and ability of the intended target to change location.

Defense against PSGMs may be achieved by blinding the inbound missile's seeker, or disabling/degrading the incoming missile seekers ability to differentiate or perceive its target. Blinding is achieved by inserting a shield such as an inert or incandescent cloud of material in front of and intersecting an inbound munitions flight path so that the energy transparency characteristics of the precision, seeker guided munition's seeker aperture or the total energy received by the seeker are changed when the PSGM views and/or transits the dispersed material cloud. Obviously the nose of the missile, containing the energy aperture or "window" as the foremost component, transits the shield first and will be impacted by whatever the shielding material consists of. During transit of the shield or cloud of material, the "window" on the nose of the missile, through which energy must pass to be received by the seeker, may be crazed, cracked, abraded and or coated to either scatter inbound energy so that target source is no longer discernible/ identifiable, or energy receipt is sufficiently outside seeker parameters so that the received energy is beyond the seekers perception threshold.

The material of the shield may or may not have obscurant characteristics similar to that of well known and documented smoke (normally white phosphorous) or other obscurants. While the dispersed material may (though it does not have to) obscure the intend target, the purpose of the dispersed material is to change the energy reception of the threat PSGMs seeker so that the seeker is no longer able to maintain a track on the intended target. With smoke or obscurants, once the PSGM has transited the obscurant cloud, it is again able to reacquire and track a target.

It is, therefore, an object of the present invention to provide an anti-missile missile with means to render the guidance system of an incoming threat missile inoperative for performing the function of guiding the incoming missile to a predetermined target.

It is another object of the present invention to provide an anti-missile missile with such means for injecting a shield material into the path of the incoming threat missile which will destroy its guidance capabilities.

It is still another object of the present invention to provide such shield material in the form of a cloud which will effectively "blind" the optical components of its guidance system as the missile penetrates the cloud.

It is yet another object of the present invention to provide such shield material which serves to coat, craze, crack, erode the seeker aperture or overload the sensing capabilities of the seeker of a precision guided missile to a level outside the parameters of the missile's seeker ability to track.

BRIEF DESCRIPTION OF THE DRAWINGS

FIG. 4*a* illustrates a typical seeker which has not been exposed to the shield means of the present invention and thereby permits energy from the target to pass there through to the guidance components of the missile and thus enable the threat missile to reach its target. FIG. 4*b* illustrates a missile seeker which has been subjected to the shield means of the present invention which has caused the seeker to be coated, crazed, cracked, eroded or overloaded and has destroyed its ability to track. FIG. 4*c* illustrates a coated seeker aperture in which no or insufficient energy passes to the control components of the threat missile.

FIG. 5 is an elevational view of a guided time fuzed missile. FIG. 6 is an elevational view of a guided, seeker missile. FIG. 7 is an elevational view of an unguided missile. FIG. 8 is an elevational view of a guided projectile.

DESCRIPTION OF THE PREFERRED EMBODIMENTS

Figure 1:
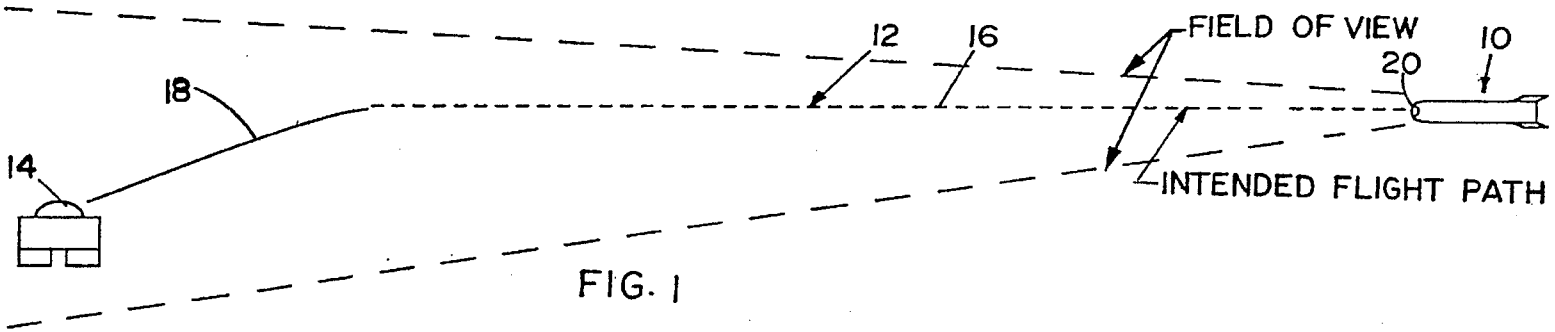
FIG. 1 is a diagrammatic illustration of a typical precision seeker guided missile in its trajectory to a target.

As shown in FIG. 1, an incoming threat missile 10 is in a trajectory 12 ending at a target 14, illustrated as being a tank. The trajectory typically includes an initial portion 16 which places the missile in the vicinity of the target and terminal portion 18 in which final course adjustments are made to assure impact of the missile with or in the immediate vicinity of the target 14. Missile 10 is shown to include a seeker 20 mounted at the forward end of the missile to receive energy containing target information. This energy may be radar, electrical impulses, laser beams, heat energy and any other type of reflection or transmissions containing target information. The received energy cooperates with guidance and control components to direct the missile to a target in known manner.

Figure 2:
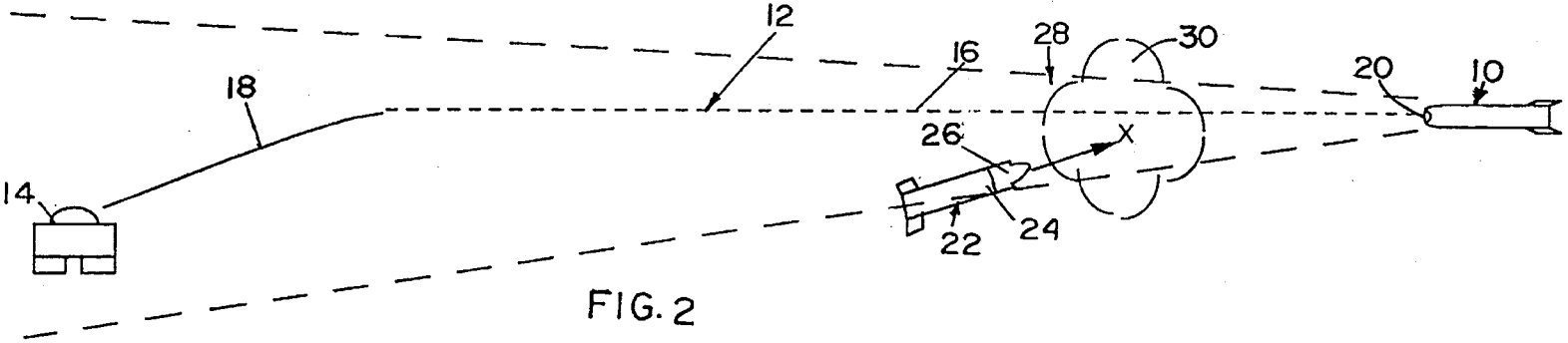
FIG. 2 is a view similar to FIG. 1 but illustrates the missile of FIG. 1 being intercepted by a shield in the form of a cloud of material capable of rendering the guidance system of the incoming threat missile incapable of operating properly.

FIG. 2 illustrates an intercept missile 22 having a body 24 including a container portion 26 for containing a shield dispersant 28. FIG. 2 illustrates the container portion as being ruptured and a dispersant 28 as having been ejected therefrom in the form of a cloud 30.

Figure 3:
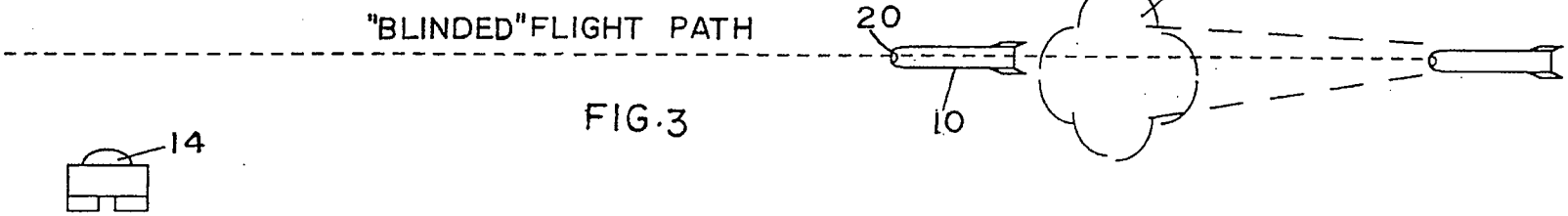
FIG. 3 is a view similar to FIG. 2 and illustrates the "blinded" trajectory of the incoming threat missile responsive to being intercepted by the shield of the present invention.

FIG. 3 illustrates the "blinding effect" created on the incoming threat missile as a result of the guidance component (seeker) being exposed to the dispersant cloud of FIG. 2. As seen in FIG. 3, the incoming threat vehicle, although not destroyed by impact is incapable of receiving guidance information from the sensor and, therefore, is incapable of being guided to the target.

Figure 4A:
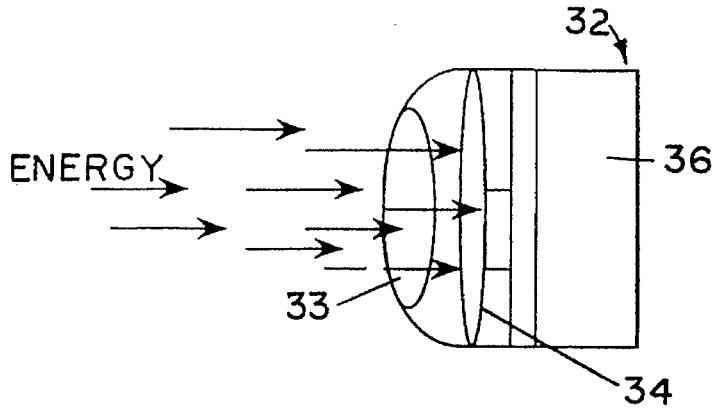
FIGS. 4*a*–4*c* are diagrammatic elevational views of various states of a missile seeker.

FIG. 4*a* illustrates a seeker aperture 32 which has not been subjected to the shield dispersants of the present invention. As shown in FIGS. 2 and 3, the unaffected seeker aperture 32 passes the incoming energy to a seeker energy receptor or antenna 34 and onto a seeker processor 36 which processes the incoming energy signals, in known manner, to guide the missile to the target.

Figure 4B:
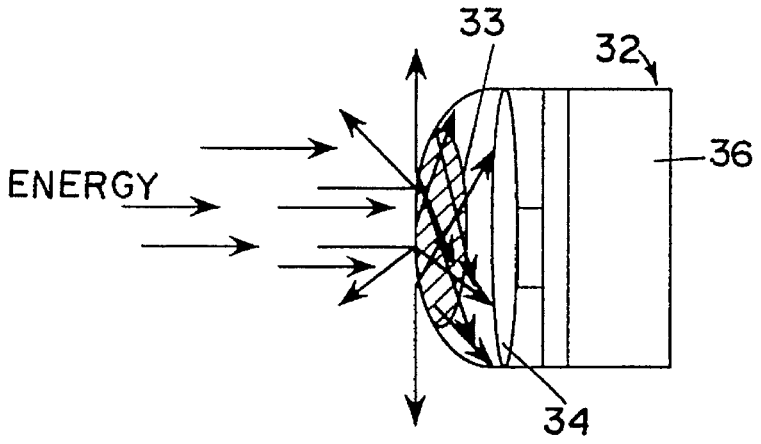

As shown in FIG. 4*b*, wherein like numerals refer to like parts, the seeker aperture 32 is illustrated as having been subjected to a dispersant containing particulants of a predetermined size and as a result has become crazed, cracked, eroded or overloaded so as to render it inoperative to pass energy to the antenna or processor.

Figure 4C:
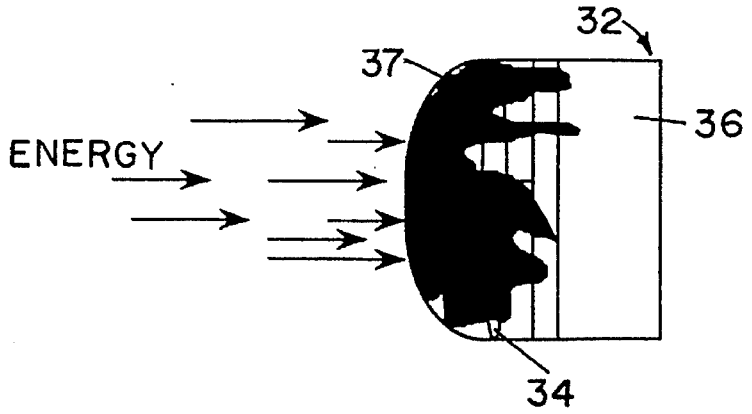

FIG. 4*c* is a view similar to FIG. 4*a*, wherein like numerals refer to like parts, but illustrates the seeker aperture as having been subjected to a coating 37 dispersant and as a result has become coated so as to blind it to incoming energy and thus render it inoperative to pass energy to the antenna or processor.

Figure 5:
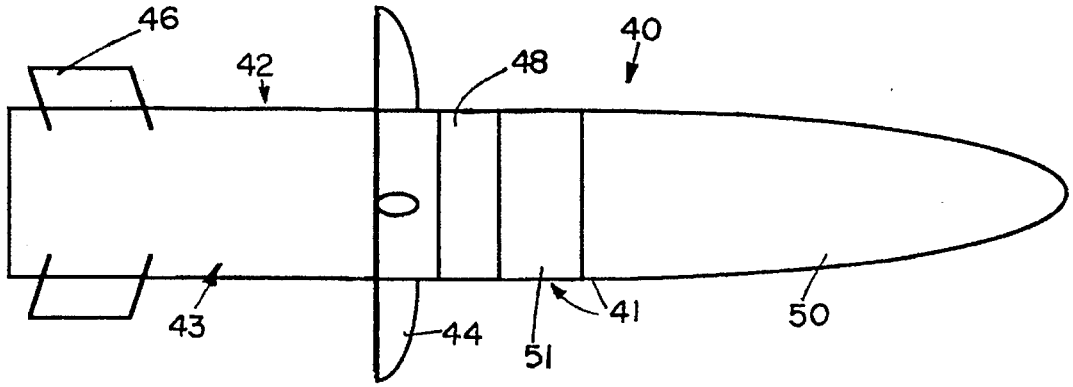
FIG. 5–8 illustrates various munitions in which the shield material of the present invention may be housed for transport to the intercept point with the incoming threat missile.

FIGS. 5–8 illustrate various anti-missile missiles in which the dispersant may be housed for transport to the intercept point with the incoming threat missile. As seen in FIG. 5, a guided time fuzed missile 40 is shown to include a body 42 having forward a forward flight control section 41 and an aft propulsion section 43 respectively provided with flight control fins 44 and 46. Section 41 includes a computer/guidance section 48, a dispersant container 50 for enclosing the shield dispersant, and a container ejection section 51 for ejecting the container 50 from the missile body, if desired.

Figure 6:
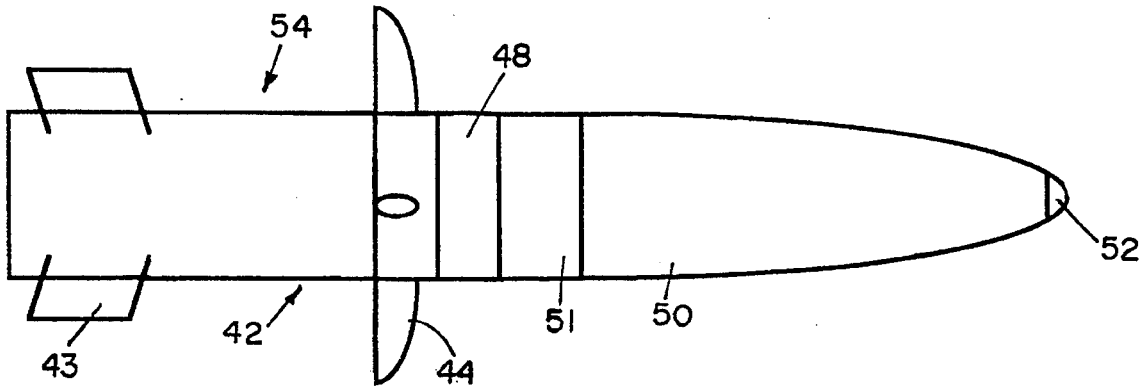

FIG. 6 is a view similar to FIG. 5, wherein like numerals refer to like parts, and illustrates a guided, seeker missile 54 containing all of the above-identified sections plus an initiator 52 such as a timer/seeker/sensor at the tip of the container to aid in guiding the anti-missile missile in its trajectory to a target and to provide an electrical signal for actuating the dispersant release mechanism at the desired time.

Figure 7:
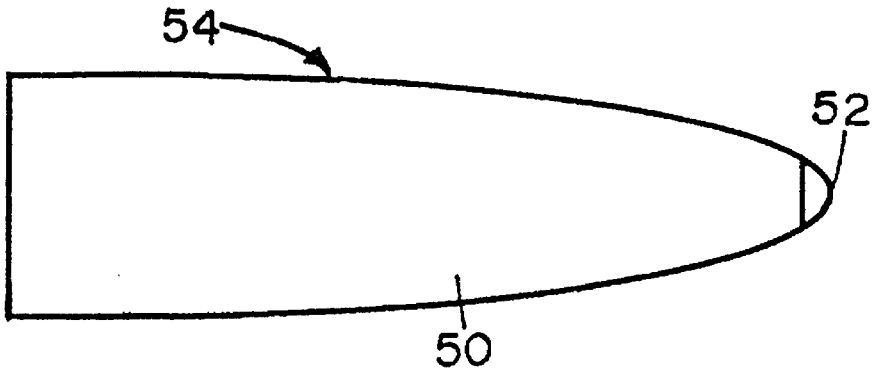

FIG. 7 is an elevational view of an unguided missile 54 which is merely shot, unguided, into the path of the threat missile and includes a container/casing 50 enclosing the dispersant and initiator 52 such as a time/sensor/seeker at the forward tip of the body of the projectile. The initiator provides an electrical pulse to actuate the dispersant release means as will be described hereinbelow.

Figure 8:
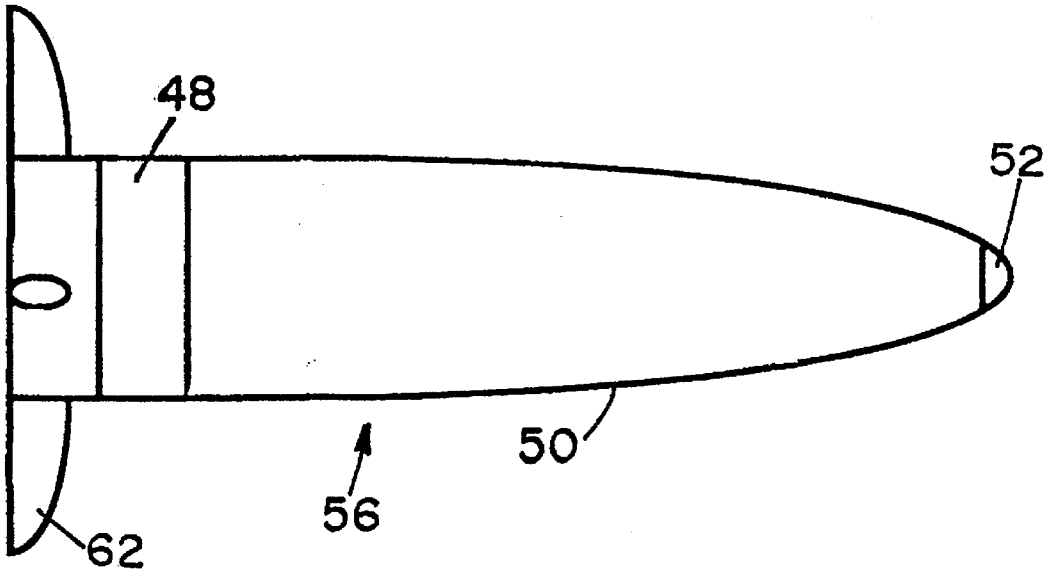

FIG. 8 is a view similar to FIG. 7 wherein like reference numerals refer to like parts, and illustrates a guided missile 56 as having the initiator 52 (such as a time/seeker/sensor) at the forward tip of the container and a guidance and control section 48 and fins 62 at the aft end of the missile. No aft propulsion section is required in this type of missile (projectile).

Figure 9:
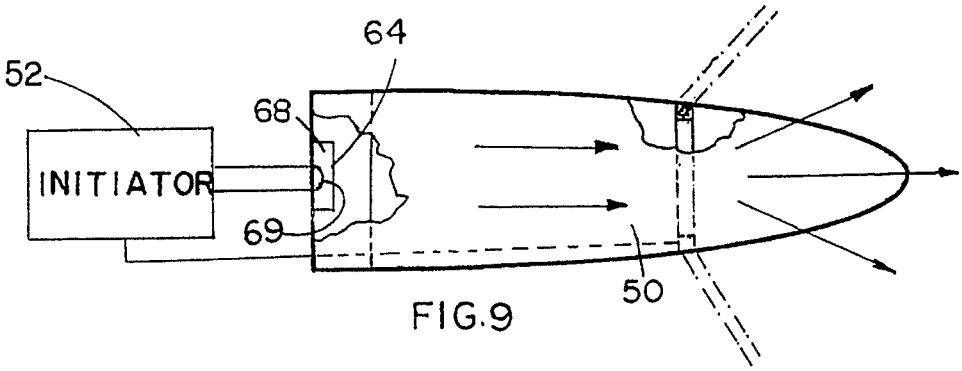
FIG. 9 is a diagrammatic view of the shield ejection system including an initiator for initiating an explosive which fractures the container for dispersion of the shield material to the atmosphere.

FIG. 9 illustrates a mechanism for rupturing the dispersant container. The mechanism includes a pressurizing container 64 which provides pressure to expel the dispersant from the container. As seen in FIG. 9, initiator 52 ignites an explosive device 68 through an exploding bridge wire 69 or the like and this detonation releases pressure from pressurizing container 64 to pressurize and rupture the dispersant container 50 so that the dispersant may be expelled to the atmosphere.

Figure 10:
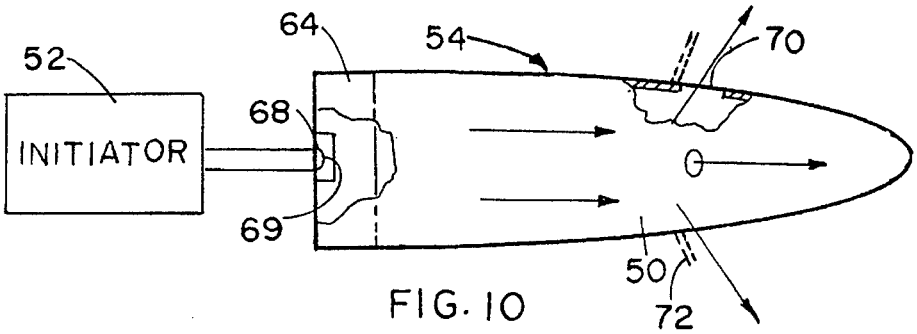
FIG. 10 is a view similar to FIG. 9 but illustrates an explosive initiator for opening ports through which the shield material is released to the atmosphere.

FIG. 10 illustrates the dispersant container 50 as being provided with ports 70 around the periphery thereof. The ports are covered with a membrane or closure member 72 which is structurally weaker than the container and is ruptured responsive to pressurization of the container by the source of pressure 64 which is actuated by a signal from an initiator 52. Upon rupturing of the closure member 72, the dispersant is expelled to the atmosphere.

Figure 11:
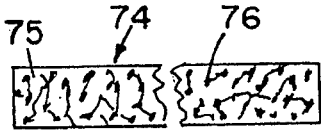
FIG. 11 is a plan view of the embodiment of the shield means wherein an adhering strip of material is provided with electrical conductors therein.

FIG. 11 illustrates a shield 74 used to disable incoming wire guided missiles. Shield 74 includes a strip of adhering material 75 having electrically conductive members 76 carried thereon.

Figure 12:
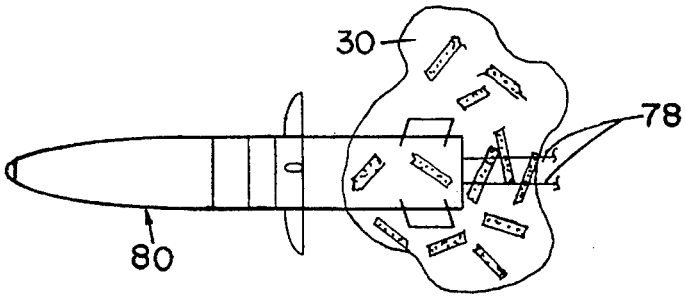
FIG. 12 is a diagrammatic view of a wire guided threat missile having tracking wires which are shown to be electrically shorted by the strips as shown in FIG. 11.

FIG. 12 illustrates a wire guided threat missile 80 having wires 78 connected thereto and to a control console. Such wire guided missiles are known in the art. The wires transmit guidance and control information to the missile for directing the missile to a target. If an electrical short occurs in the wires, target information cannot be received by the missile. The present invention provides a means whereby such an electrical short can be made to occur. This is accomplished by providing missile 10 with a shield container 50 which contains the conductive adhering strips 74 of FIG. 11 and ejecting this shield material in the manner discussed supra, the adhering conductive strips will adhere to the trailing wires and provide an electrical short in the wires.

It is to be understood that the device used to blind a PSGM consists, minimally, of a dispersant delivery mechanism/system, a dispersant ejection mechanism and a dispersant of "blinding" material.

The shield means delivery mechanism/system of the present invention in its most basic form can be as simple as a container/casing that is projected/shot to intercept the inbound flight path of the threat precision, seeker guided missile. An initiator such as a timer (time determined and set by the launching mechanism) or an in-projectile sensor activator initiates the dispersant mechanism when the threat missiles flight path is intercepted. FIGS. 7 and 8 illustrate such delivery system. Complexity and sophistication can be increased such that the delivery system is self propelled, contains a guidance, control and seeker systems and has the capacity to detect the inbound precision guided munition, project its flight path, plot it's own flight path to an intercept point and initiate dispersion at a optimal time for maximum pattern penetration by the inbound munition. FIGS. 5 and 6 illustrate such delivery systems.

It is to also be understood that the dispersion mechanism can be any of a multitude of well known methods or mechanisms. For example, the dispersion mechanism may be as simple as the fracturing of the casing of the material container and using the relative air stream velocity as the dispersant force. The dispersion mechanism may be mechanical (spring, gas, pyrotechnique, etc.) that either fractures the case and disperses the material or ejects the material through orifices, ports or other exits. The dispersion mechanism may be an explosive or pyrotechnique that is separate from the dispersant material, embedded in the dispersant material or be a component of the dispersant material. It is to be further understood that the dispersed material is used to change the characteristics (amount) of energy entering said aperture to thereby affect the operational capabilities of the guidance and control components. This is accomplished by altering the energy transmissivity of the PSGMs energy receiving aperture by destroying or modifying the energy transparent aperture on the PSGM through which the energy must pass in its traverse to the guidance and control system or by overloading the seeker's sensing capability. To achieve this result, the material may be one of, or a combination of the following:

1. A dense or sufficiently sized cloud of particulants that will crack, shatter or stove in the energy transparent aperture of the threat precision, seeker guided munition thus destroying/degrading the seeker or rendering the seeker incapable of performing its function.
2. A silica or other abrasive material that will craze, abrade, erode, corrode, minutely fracture or otherwise change the energy transparency properties of the threat seekers aperture cover so that the energy received by the seeker is not usable in tracking its target.
3. An adhering material be it a paint type or a pyro-type material that coats the transiting PSGMs energy transparent aperture and makes it opaque. By application of an opaque coating the energy of interest to the seeker no longer can pass through the cover or can not pass through in sufficient quantity for the seeker to discriminate it's target and track on it. In the case of a munition with an on board radar, the applied material may cause an intense reflected return from the on board radar's emissions that overloads, damages or renders the seeker non-operational, or it may reduce the return inbound energy to below the seeker's perception threshold.
4. The adhering material may be in the form of fine strands or strips that would, on impact, adhere to the nose of the munition and cover the energy transparent aperture thus reducing or completely eliminating the passage of the required energy and "blinding" the munition.

5. The material may be of a form that will burn or incandesce so that sustained increase in available energy entering the seeker overloads the seeker reception ability or drowns out the energy of interest. The material may continue to burn or incandesce even as it impacts and adheres to the PSGM's nose. An example of such material is magnesium oxide. Ignition of the magnesium oxide may be accomplished by the initiator at the time the initiator energizes the pressurizing source.

6. The adhering material may include metallic elements to short the trailing command cables on PSGMs that are guided by electrical command wires.

The present invention lends itself to incorporation into or with other defensive systems, either as a separate component or as a part of another munition For example, proposals have been made to build small munitions that would destroy inbound threat munitions by kinetic kill or near explosion. The addition of the blinding mechanism and materials to a kinetic kill or explosive warhead munition would materially expand the probability that the munition would render the inbound threat ineffective. The blinding mechanism and material would be deployed as described and the kinetic kill or explosive warhead would continue as designed and attempt to kill the inbound threat. If an explosive or kinetic kill were not achieved, the deployed blinding materials would achieve, what in military parlance is known as a "soft" kill, as a back-up. Such a system would greatly enhance the probability of rendering the threat munition ineffective.

It is to be understood that the word "missile" as used herein refers to an object which is launched toward a target. Such objects, of course, include guided or ballistic missiles, rocket propelled vehicles and other munitions and projectiles.

I claim:

1. An anti-missile missile for "blinding" an incoming, threat, precision, seeker, guided missile in its trajectory to a target without requiring impact of said anti-missile missile with said incoming threat missile, said incoming missile having a guidance and control system and a seeker having an aperture through which energy which contains target information is directed to said guidance and control system of said threat missile, said anti-missile missile comprising:

a body having a container portion enclosing shield means, said shield means disposed for controlling the total energy received in said seeker aperture to alter the operational capabilities of said guidance and control system; and means for ejecting said shield means from said container portion at a predetermined point in the vicinity of said trajectory, said shield means being a blinding material defined as a coating material which adheres to said seeker to prevent said incoming energy from entering said seeker.

2. An anti-missile missile as in claim 1, wherein said coating material is in the form of fine strands or strips that, on impact, adhere to said seeker.

3. An anti-missile missile for "blinding" an incoming, threat, precision, seeker, guided missile in its trajectory to a target without requiring impact of said anti-missile missile with said incoming threat missile, said threat missile having a guidance and control system and a seeker having an aperture through which energy which contains target information is directed to said guidance and control system of said threat missile, said anti-missile missile comprising:

a body having a container portion enclosing shield means, said shield means disposed for controlling the total energy received in said seeker aperture to alter the operational capabilities of said guidance and control system;

means for ejecting said shield means from said container portion at a predetermined point in the vicinity of said trajectory, said ejection means including means for rupturing at least a portion of said container portion of said missile for release of said shield means to the atmosphere, and a pressurizing medium carried in said container portion for pressurization thereof to exert pressure on said shield means for release of said shield means from said container portion of said missile; and said at least a portion of said container portion includes a plurality of ports disposed around the periphery thereof including cover members disposed for rupturing to release said shield means.

4. A system for defending against incoming threat missiles including a defensive missile for preventing an incoming threat missile from impact with a target without the need for impact between said defensive missile and said threat missile, said threat missile having guidance components, controlled by external energy signals and external trailing conductors for transmitting said energy signals to said guidance components, said defensive missile comprising:

a body having a container portion;

shield means carried in said container portion of said defensive missile, said shield means disposed for preventing said energy signals from reaching said guidance components of said threat missile, said shield means of said defensive missile including shorting means for creating a short circuit in said trailing wires to prevent said energy signals from reaching said guidance components of said threat missile; and ejection means for ejecting said shield means from said container in the vicinity of said threat missile.

5. A system as in claim 4 wherein said shorting means comprises at least one strip of adhering material having electrically conductive members disposed therein.

6. A system as set forth in claim 4 wherein said guidance components of said threat missile includes a seeker aperture to receive said energy signals and said shield means includes means to alter the permissivity of said seeker aperture to prevent said energy signals from reaching the guidance and control components of said threat missile.

7. An anti-missile missile for preventing an incoming threat missile from impacting a target within the lower atmosphere without requiring impact of said anti-missile missile with said incoming threat missile, said incoming threat missile having a guidance and control system disposed for receiving a source of energy from an external source for guiding said threat missile to impact with said target, said anti-missile missile comprising:

a body;

a container carried by said body;

shield means carried in said container for ejection from said container in the vicinity of said threat missile, said shield means being an abrasive which crazes, cracks, or stoves the seeker to prevent said source of external energy from entering said seeker to thus limit the amount of said energy received by said guidance and control system ineffective to guide said threat missile to said target; and ejection means for ejecting said shield means in the lower atmosphere in the vicinity of said threat missile.

8. An anti-missile missile for preventing an incoming threat missile from impacting a target without requiring impact of said anti-missile missile with said incoming threat missile, said incoming threat missile having a seeker provided with an aperture having a window and a guidance and control system disposed for receiving a source of energy from an external source associated with said target, through said seeker aperture window, for guiding said threat missile to impact with said target, said anti-missile missile comprising:

a body;

a container carried by said body;

shield means defined as silica material carried in said container for ejection from said container in the vicinity of said threat missile, said shield means disposed for physically altering said aperture window so that insufficient energy from said external source is passed therethrough for operational control of said guidance and control system thereby rendering said guidance and control system ineffective to guide said threat missile to said target; and ejection means for ejecting said shield means in the vicinity of said threat missile.

9. An anti-missile missile for preventing an incoming threat missile from impacting a target without requiring impact of said anti-missile missile with said incoming threat missile, said incoming threat missile having a seeker provided with an aperture having a window and a guidance and control system disposed for receiving energy from an external source associated with said target, through said seeker aperture window, for guiding said threat missile to impact with said target, said anti-missile missile comprising:

a body;

a container carried by said body;

shield means carried in said container for ejection from said container in the vicinity of said threat missile, said shield means being a material capable of sustained incandescence before and at contact and disposed for physically altering said aperture window so that insufficient energy from said external source is passed therethrough for operational control of said guidance and control system thereby rendering said guidance and control system ineffective to guide said threat missile to said target; and ejection means for ejecting said shield means in the vicinity of said threat missile.

10. An anti-missile missile as in claim 9 wherein said incandescence is provided by burning said material.

* * * * *